United States Patent [19]

Hernborg

[11] 3,980,862

[45] Sept. 14, 1976

[54] APPARATUS FOR ELECTRIC HEATING OF FLUIDS

[75] Inventor: Gunnar Hernborg, Trosa, Sweden

[73] Assignee: Aktiebolaget Atomenergi, Stockholm, Sweden

[22] Filed: Jan. 30, 1974

[21] Appl. No.: 437,939

[52] U.S. Cl. ..... 219/300; 219/273; 219/275; 219/376; 239/136

[51] Int. Cl.[2] ..... H05B 3/00; F22B 1/28

[58] Field of Search.... 219/300, 303, 304, 271–276, 219/375, 376; 222/146 HE; 239/135, 136

[56] References Cited

UNITED STATES PATENTS

| | | | |
|---|---|---|---|
| 912,994 | 2/1909 | Conrad | 219/300 |
| 1,019,413 | 3/1912 | Batchelder | 219/300 X |
| 1,190,167 | 7/1916 | Hill | 219/300 |
| 1,646,912 | 10/1927 | Hodshon | 219/304 |
| 2,033,111 | 3/1936 | Carleton | 219/300 X |
| 2,074,456 | 3/1937 | Carleton | 219/300 UX |

FOREIGN PATENTS OR APPLICATIONS

| | | | |
|---|---|---|---|
| 123,512 | 2/1947 | Australia | 219/300 |
| 104,997 | 12/1926 | Austria | 219/300 |
| 338,740 | 11/1930 | United Kingdom | 219/300 |
| 16,214 | 6/1914 | United Kingdom | 219/300 |
| 117,394 | 5/1958 | U.S.S.R. | 219/300 |

*Primary Examiner*—A. Bartis
*Attorney, Agent, or Firm*—Toren, McGeady and Stanger

[57] ABSTRACT

An electric fluid heating apparatus include a number of electrically conductive pipe coils arranged side by side in parallel and connected to and extending between inlet and outlet pipes for flowing the fluid to be heated from the inlet pipe to the outlet pipe. Each pipe coil is disposed in a vertical plane and comprises a plurality of vertically extending laterally spaced pipe sections joined by U-bends at the top and bottom to form a single continuous serpentine coil. The central electrical points of the pipe coils are electrically connected to the phases of a polyphase alternating current source in a repetitive order and means associated with the ends of each pipe coil completes the circuit to the respective phases whereby the coils are resistively heated by the current flowing therethrough.

9 Claims, 8 Drawing Figures

Fig. 2
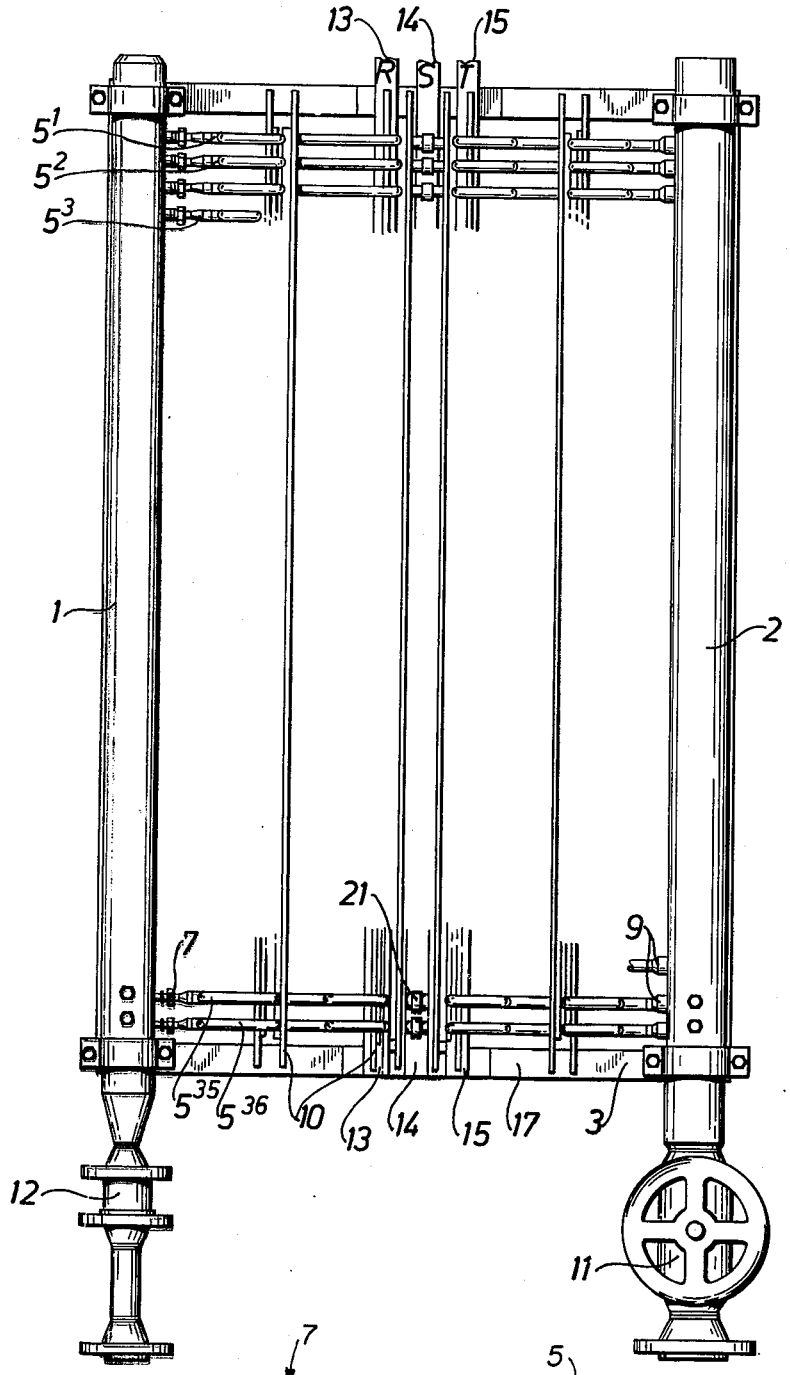
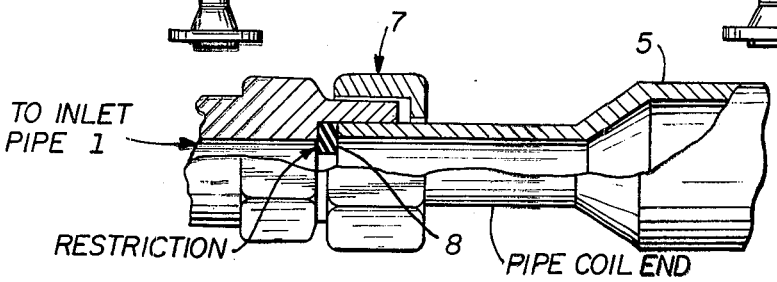
Fig. 2A

APPARATUS FOR ELECTRIC HEATING OF FLUIDS

This invention relates to an apparatus for electrically heating a fluid, i.e. an electric boiler. The apparatus according to the invention is particularly suitable for heating water in order to generate steam.

Electric boilers are known, which have electric heating means arranged inside a vessel. However, such boilers have many disadvantages. Thus, generally the heating is not uniform, the heating being concentrated to the area of said heating means, which might lead to local boiling and to substantial deposits on said heating means. In the case of a high pressure electric boiler, the boiler must be designed in accordance with current pressure vessel standard specifications, which leads to a heavy and clumsy construction that is difficult to transport from one place to another. Furthermore, the lead-in means necessary for said electric heating means easily give problems.

Also, electric boilers are known, in which heating takes place in pipes being heated by the passage of electric current through the walls of said pipes. However, the constructions used are not satisfactory, particularly when operating at high power and thus very high currents, which can give problems such as impedance losses and vibrations due to induced mechanical forces.

The object of the invention is to provide an electric boiler, particularly an electric steam boiler, in which the above-mentioned problems and disadvantages are removed.

According to the invention, this is accomplished by providing an apparatus having an inlet and an outlet pipe of an electrically conducting material, between which a number of pipe coils of an electrically conducting material are coupled. Preferably, the pipe coils are identical. On its inlet side each pipe coil suitably has an inlet restriction, said restrictions making it possible to adapt the apparatus to various operating conditions. Means are arranged for supplying electric current to said pipe coils to heat the pipe coils and thereby the fluid flowing through the pipe coils from said inlet pipe to said output pipe. The number of pipe coils is evenly divisible by $n$, preferably by three, said current supply means including a current source having n phases, preferably three phases, each of the phases being electrically connected to $1/n$, preferably a third, of said pipe coils. Preferably, each phase is electrically connected substantially to the electrically central points of the associated pipe coils, whereby said inlet pipe and said outlet pipe can be electrically connected to each other and to the neutral point of the current source and/or earth, which gives great advantages from the safety point of view.

Preferably, said inlet and outlet pipes are parallel, the pipe coils being arranged in parallel planes perpendicular to said inlet and outlet pipes.

According to one embodiment of the invention each of the phases of the current source is connected to an associated current bar, the bar preferably being arranged parallel to said inlet and outlet pipes and adjacent to the central points of the pipe coils. Advantageously, the pipe coils are in turn electrically connected to said current bars.

According to another preferred embodiment of the invention each of the pipe coils is connected to a separate, associated current bar. The current bars, the number of which thus corresponds to the number of pipe coils, extend parallel to each other and with small distances between one another and are in turn connected to the phases of the current source. Due to such a laminated structure impedance losses of the connection between the current source and the pipe coils are substantially reduced. The laminated structure suitably is maintained all the way to the current source. By keeping the current bars separated by means of electrically insulating spacer means cooling air can circulate between the current bars.

Suitably the current source includes a three-phase transformer having a low phase output voltage, preferably below 84 volts, i.e. the pipe coils are supplied with extra-low voltage so that the pipe coils need not have special insulation or be semi-protected.

Due to the fact that even thin-walled and light pipes withstand high pressures, the present invention makes it possible to provide a high pressure and high power electric steam boiler being sufficiently light and compact so as to be transportable between different working places. At high powers the transformer, if used, will be the dominating part of the apparatus; however, the specific current supply system of the invention makes it easy to separate the pipe unit and the tranformer and to transport them separately.

The capacity of the boiler can be easily changed by connecting a greater or a lesser number of pipe coils. It should be noted that the internal volume of the boiler is very small relative to the capacity in comparison with conventional steam boilers.

The present invention also means that problems of heat losses into the surrounding area almost cease to exist. Naturally, the pipe coils will be hot but the contact surface between the pipe coils and the surrounding air is small. Furthermore, the heat transfer coefficient between the external walls of the pipe coils and the air is very low compared to the heat transfer coefficient between the internal walls of the pipe coils and the fluid. Therefore, in most cases no special insulation is needed, but if such an insulation nevertheless is considered necessary, it can be easily provided by means of a casing, cover or the like.

In most cases the geometric central points of the pipe coils, to which the current supply is most easily accomplished, and the electric central points of the pipe coils will not be the same, because the two halves of each pipe coil will not have the same temperature distribution and, consequently, will not have the same resistance. However, generally this is of no significance but can be compensated for by not making the coil halves identical or simply by suitably displacing the current supply conductors away from said geometric central points.

The invention will be better understood from the following description of examples and the accompanying drawings, in which:

FIG. 2 is a top view, with parts broken away, of the apparatus shown in FIG. 1;

FIG. 2A is an enlarged detail view of the connection between the inlet pipe and one of the pipe coils;

Figure 3A:
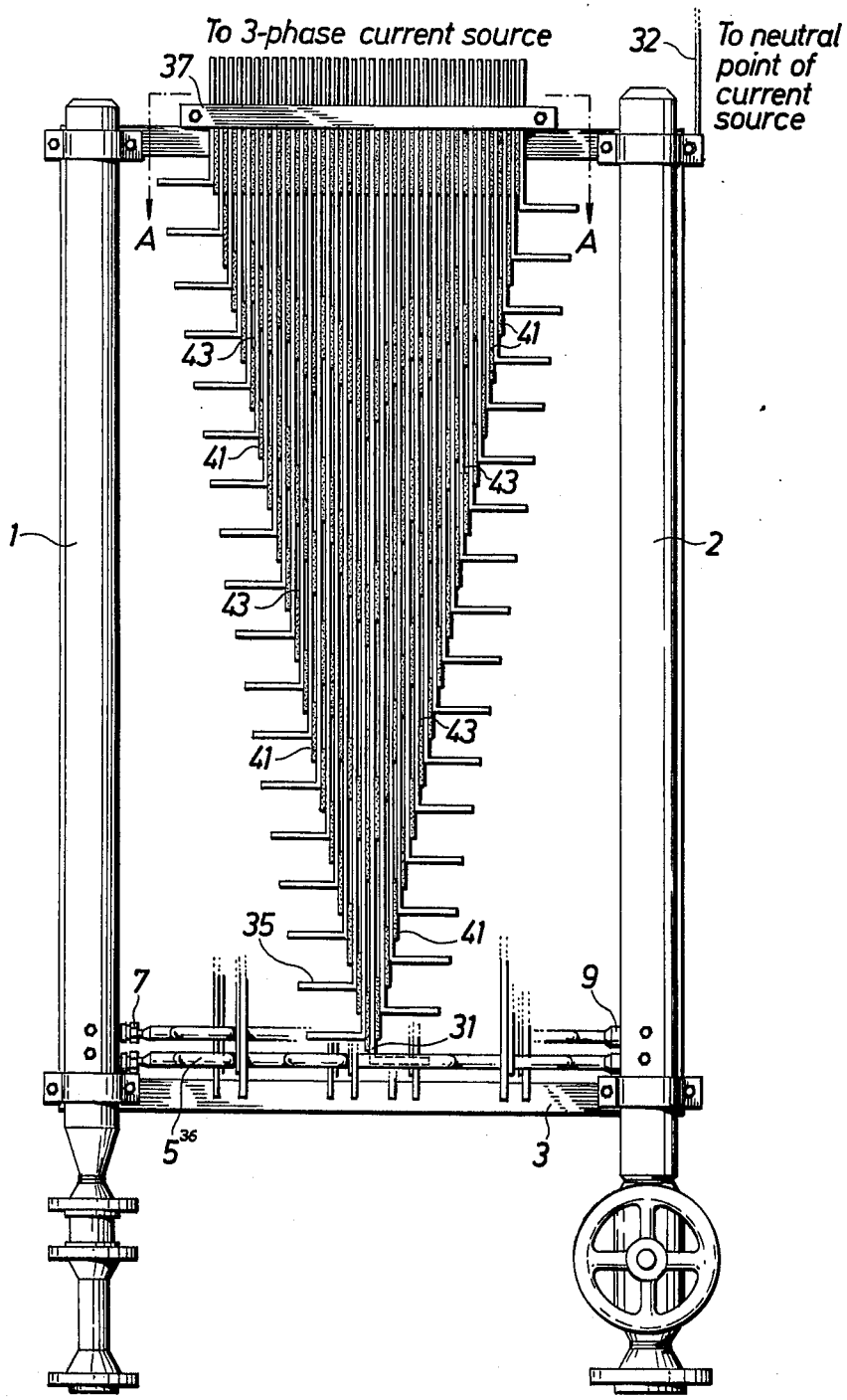
Figure 3B:
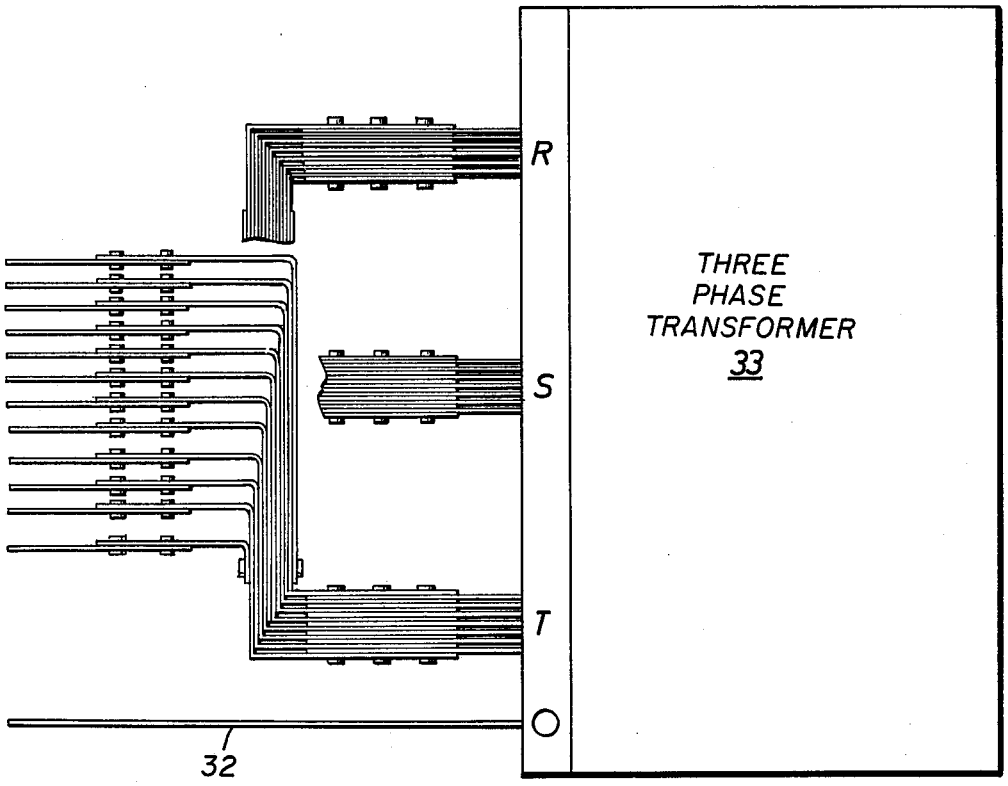
Figure 4:
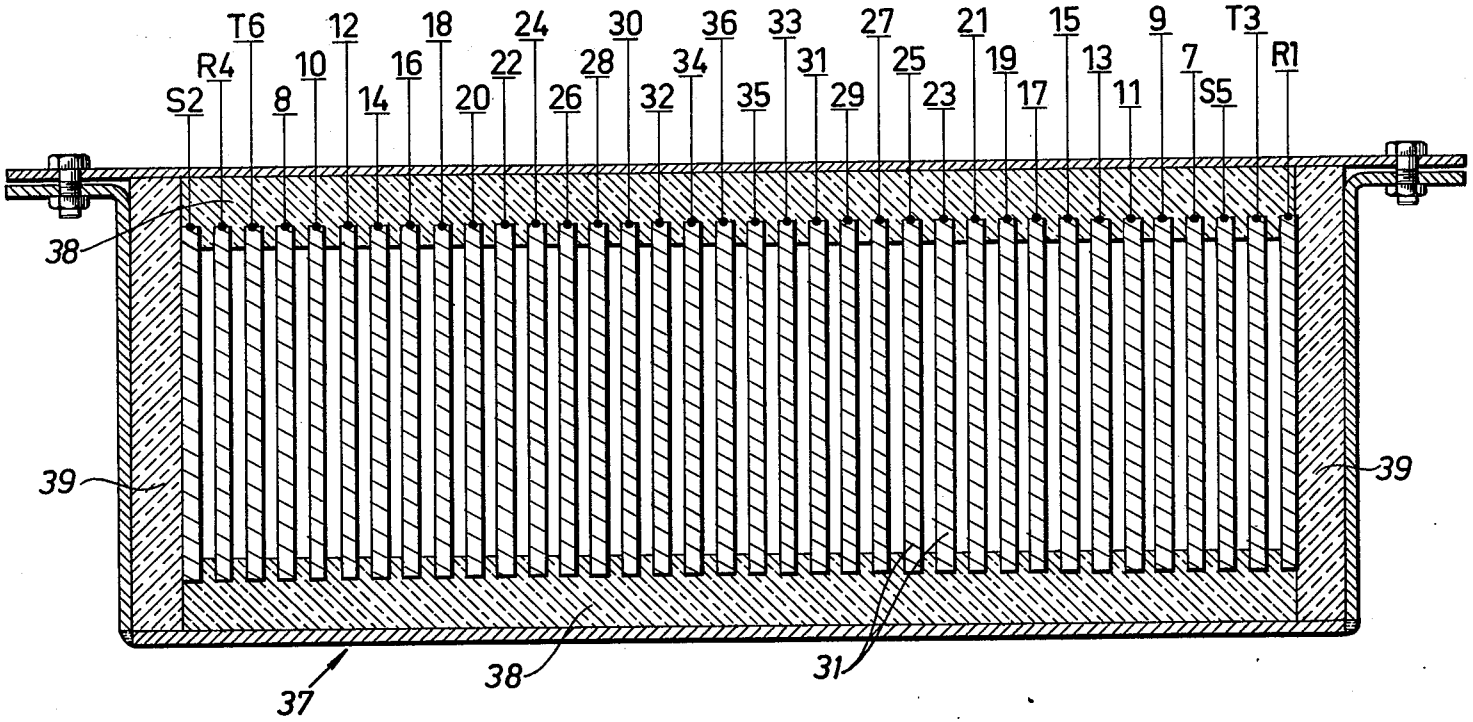
Figure 5:
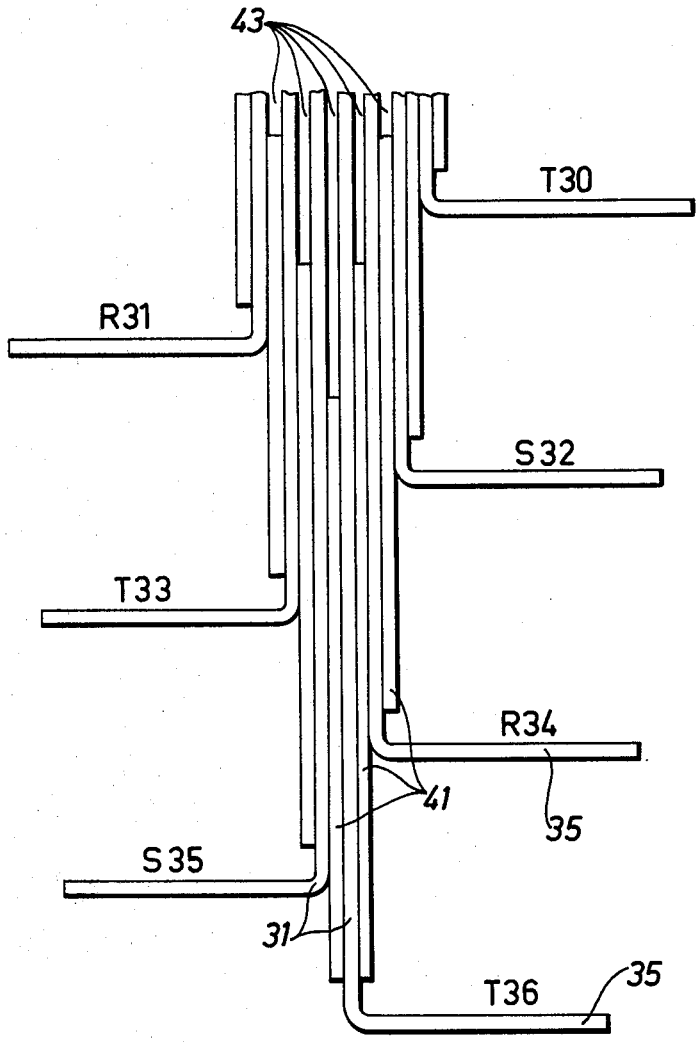

FIGS. 3A and 3B together are a schematic top view of another apparatus embodying the invention;

FIG. 4 is an enlarged sectional view taken along line A—A in FIG. 3A and illustrating the arrangement of the current bars and their distribution on the three phases of the current source; and FIG. 5 is an enlarged detail view of the current bars in FIG. 3A.

Figure 1:
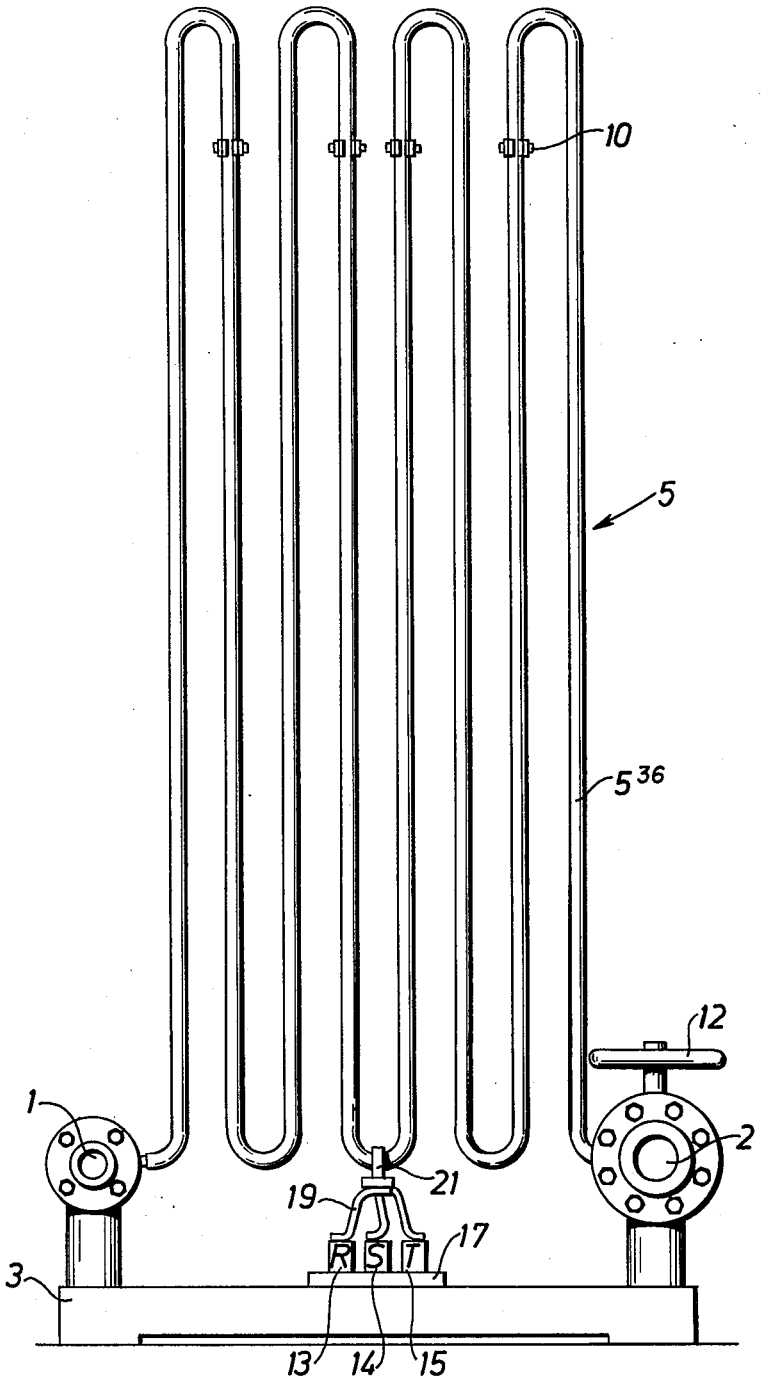
FIG. 1 is a front view of an apparatus embodying the invention.

The apparatus according to FIGS. 1 and 2 is primarily intended for steam generation and includes an inlet pipe 1 and an outlet pipe 2, which are arranged in parallel on a fixed or transportable frame 3. Between said inlet and outlet pipes, which are of an electrically conducting material, there are connected 36 vertical, parallel pipe coils 5 of a resistance material such as stainless steel. To make FIG. 2 more clear only five pipe coils $5^1$, $5^2$, $5^3$, $5^{35}$, and $5^{36}$ are shown, while the positions of the remaining pipe coils merely are indicated.

The pipe coils 5 are coupled to the inlet pipe 1 and the outlet pipe 2 via couplings 7 and 9, respectively, said couplings being arranged on connection pipes welded to said inlet and outlet pipes. The couplings 7, i.e. the inlets of the pipe coils 5, include restrictions 8 which are easily exchangeable. The pipe coils are stayed mechanically by means of support means 10, said support means being electrically insulated from the pipe coils. In order to make FIG. 2 more clear said support means 10 are only partially shown.

The outlet pipe 2, which has greater diameter than the inlet pipe 1, has a valve 11 thereon. Also, the outlet pipe can be provided with a safety valve as well as means for steam blowing and water discharge (not shown). The inlet pipe 1 is provided with a measuring means for flow measurements.

Below the central points of the pipe coils 5 there are three current or bus bars 13, 14 and 15, said bars being arranged on a suitable number of insulators 17 that are fixed to said frame 3. Current bar 13 is electrically connected to the R-phase of a three-phase current source (not shown), current bar 14 is electrically connected to the S-phase of said current source and current bar 15 is electrically connected to the T-phase of said current source. The central points of the pipe coils 5 are by turns electrically connected to the current bars 13, 14, and 15. Thus, the central point of pipe coil $5^1$ is electrically connected to current bar 15, the central point of pipe coil $5^2$ to current bar 14, the central point of pipe coil $5^3$ to current bar 13, the central point of pipe $5^4$ to current bar 15, and so on, the central point of the last pipe coil $5^{36}$ being connected to current bar 13, as indicated in FIG. 1. The electrical connection of the central points is achieved by means of flexible cables 19 being connected to the current bars for instance by bolted joints (not shown) and to connecting means 21 fixed to the central points of the pipe coils.

The current source connection described means that the current source will have balanced load, i.e. the three phases of the current source will be symmetrically loaded. The inlet pipe 1 and the outlet pipe 2 will be center points of star-connected loads formed by the pipe coils and consequently, they can be electrically connected to each other and to earth and possibly to the neutral point of the three-phase current source. Therefore, the inlet pipe 1 and the outlet pipe 2 need not be electrically insulated from the frame 3, if the latter is electrically conducting, or from other pipes or conduits coupled to said inlet and outlet pipes, which other pipes can be grounded.

FIGS. 3A, 3B, 4 and 5, of which FIG. 3B is a direct continuation of FIG. 3A, illustrate another manner in which the pipe coils are connected to a current source being a three-phase transformer, the apparatus otherwise being in conformity with the apparatus of FIGS. 1 and 2.

In this case each pipe coil 5 is supplied with current over a separate associated current bar 31 extending below the pipe coils parallel to the inlet and outlet pipes 1 and 2. The current bars 31 are thin copper bars arranged edgeways and located close to each other. The bars are by turns connected to the three phases R, S, and T of the transformer 33 in order to avoid impedance losses. For the same reason the bars are arranged symmetrically relative to the center line of the apparatus. Each current bar 31 has a terminating end portion 35 at right angles to the main portion of the bar, said angle portion 35 being parallel to and located below the associated pipe coil 5. The connection (not shown) between the central point of a pipe coil 5 and the angle portion 35 of the associated current bar 31 is achieved by means of one or more flexible cables, which can be attached by bolted joints.

The current bars 31 are located and separated by means of insulating support means (not shown) arranged on the electrically conducting frame 3 and by means of insulating spacer means 41 (FIG. 5) arranged between the current bars. The apparatus also includes a combined support and spacer means 37 attached to said frame where the current bars 31 arrive below the pipe coils. As evident from FIG. 4, showing a cross section through said means 37, the latter includes insulating blocks 38, 39, of which the two opposed blocks 38 are provided with separated grooves for receiving the edge portions of the current bars 31. Consequently, the side surfaces of the current bars are in contact with the air which affords a cooling effect. FIG. 4 also shows how the 36 current bars 31 are by turns and symmetrically connected to the three phases R, S, T of the transformer 33 and to the pipe coils 5. Thus, the current bar furthest to the right in FIG. 4 and referred to as R1 is connected to the R-phase of the transformer and to pipe coil $5^1$, while the next current bar T3 is connected to the T-phase of the transformer and to pipe coil $5^3$ and so on in a repetitive order.

The above-mentioned reference system is also used in FIG. 5, said figure showing the point portion of the pyramidal, "laminated" package of current bars 31 in a larger scale. As evident from said figure, the spacer means 41 between the current bars are of limited extension so that there are air slots 43 between the current bars 31, which means improved cooling.

The current bars 31 are connected to the transformer in direct connection with the latter, that is the laminated structure is maintained as far as possible in order to reduce the impedance losses. However, to make FIGS. 3A and 3B more clear only the current bars connected to the T-phase are shown after the support and spacer means 37.

The connection to the transformer is produced by extending the current bars of each phase into a separate room position, the bars of each phase then being connected to each other and to the associated phase connection of the transformer.

If the alternating current source 33 has a neutral point 0, the point is suitably electrically connected to the frame 3 and thus, to the inlet and outlet pipes 1 and 2 via a connection means 32.

In the operation of an apparatus according to FIGS. 1 or 3 water is pumped into the inlet pipe 1. The water flows into the pipe coils 5 via the couplings 7, the water then flowing through the pipe coils 7 while being simultaneously and progressively heated. Suitably, the heating effect is adjusted so that there will be a mixture of water and steam in the outlet pipe 2. If the water has to be removed, this can suitably be done in a separate vessel (not shown) coupled to the outlet pipe 2, from which the water is brought back to the inlet pipe 1 and the steam can be delivered separately.

The inlet restrictions 8 in the couplings guarantee that water is passed through the pipe coils 5 under equal conditions as well as guarantee a pressure drop meaning a certain safety against overheating when generating steam. Thus, the restrictions 8 that are easily replaceable make it possible to adapt the apparatus according to the invention to various loading conduits and loads of different lengths and dimensions. Thus, the restrictions give a controlling effect, which means that substantially the same pressure drop is obtained across the apparatus at various steam pressures. During certain operating conditions the restrictions may even make a separate steam operator unnecessary.

Although an apparatus according to the invention will supply strongly heated water or steam very soon after starting up, in a practical embodiment having the dimensions 2.3 × 2.5 × 3.1 *m* (the transformer not included) the heat generation can reach up to 6 MW in 30 seconds, it may in certain cases be suitable initially to circulate the water and steam, if any, by means of a direct feedback from the outlet side to the inlet side, until the water and the steam have been heated enough to be used. Feed-back circulation may also be used in such cases where the temperature of the water, for instance, of a plant is to be raised successively for testing purposes. The water and steam that may occur are then pumped from the outlet pipe through the plant to the inlet pipe to be further heated, said further heating being controlled by adjusting the electric power supplied. This arrangement of an apparatus according to the invention is particularly well suited for heating-up nuclear reactors for pre-critical purposes. Thus, the apparatus according to the invention can be located within or outside the reactor building without any risk of polluting the surroundings.

What is claimed is:

1. An apparatus for high power electric heating of a fluid, the apparatus comprising an inlet pipe and an outlet pipe each formed of an electrically conducting material, a number of pipe coils formed of an electrically conducting material and connected to and extending between said inlet and outlet pipes for flowing the fluid from said inlet pipe to said outlet pipe, each said pipe coil being arranged in a vertical plane with the vertical planes of said pipe coils disposed in parallel relation, each said pipe coils being serpentine shaped and comprising a plurality of vertically extending laterally spaced pipe sections arranged approximately parallel and U-bends connecting the ends of the pipe sections together to form a single continuous pipe coil, a restriction located in each said pipe coil at its connection to said inlet pipe, an alternating current source for supplying electric current to each of said pipe coils for resistive heating thereof and thereby of the fluid flowing therethrough, said alternating current source having $n$ phases and said plurality of pipe coils being a multiple of $n$, means connecting each of the phases of said alternating current sources to a different $1/n$ of said plurality of pipe coils substantially at the central points thereof located midway along the pipes of the pipe coils between said inlet and outlet pipes, and means associated with the ends of each of said pipe coils for completing the circuit to the respective phases of the alternating current source.

2. An apparatus as claimed in claim 1, wherein said connecting means includes a separate current bar for and electrically connected to each of said pipe coils, said current bars extending substantially parallel to each other and being electrically connected to the phases of the alternating current source in a regular alternating and repetitive order.

3. An apparatus as claimed in claim 2, wherein the central points of said pipe coils are located generally along a line extending substantially perpendicularly to said vertical planes of said pipe coils, and said current bars being arranged symmetrically relative to said line.

4. An apparatus as claimed in claim 2, wherein said alternating current source includes a polyphase transformer having low phase voltage and transformer connection means, said current bars associated with each phase of said transformer being connected to each other only at said transformer connection means.

5. An apparatus as claimed in claim 2, wherein said pipe coils form a generally parallelepipedal pipe bundle, the central points of said pipe coils being located at the bottom of said bundle, and said current bars being arranged below the bottom of said pipe bundle.

6. An apparatus as claimed in claim 1, wherein $n = 3$.

7. An apparatus for high power electric heating of a fluid, comprising an inlet pipe and an outlet pipe each formed of an electrically conducting material, said inlet and outlet pipes arranged horizontally and being disposed in substantially parallel relation, a plurality of vertically extending serpentine shaped pipe coils, said pipe coils being formed of an electrically conducting material and connected to and extending between said inlet and outlet pipes for flowing the fluid from said inlet pipe to said outlet pipe, each said pipe coil arranged in a vertical plane with the vertical planes of said pipe coils disposed in parallel relation, a restriction located in each said pipe coil at its connection to said inlet pipe, an alternating current source for supplying electric current to each of said pipe coils for resistive heating thereof and thereby of the fluid flowing therethrough, said alternating current source having n phases and said plurality of pipe coils being a multiple of N, and means for electrically connecting each of the phases of said alternating current source to a different 1/n of said plurality of pipe coils substantially at the central points of said pipe coils located midway along the pipes of the pipe coils between said inlet and outlet pipes, said means including a separate current bar for each of said pipe coils, said current bars extending substantially parallel to said inlet and outlet pipes, the central points of said pipe coils being located generally along a line extending substantially perpendicularly to the vertical planes of said pipe coils, said current bars being arranged symmetrically relative to the line along which the central points of said pipe coils are located, said current bars being electrically connected to the phases of the alternating current source in a regular alternating and repetitive order, and means associated with the ends of each of said pipe coils for completing the circuit to the respective phases of the alternating current source.

8. An apparatus as claimed in claim 7, wherein said pipe coils form a generally parallelepipedal pipe bundle, each pipe coil having its central point at the bottom of said bundle, and said current bars being arranged below the bottom of the pipe bundle.

9. An apparatus for high power electric heating of a fluid, the apparatus comprising an inlet pipe and an outlet pipe each formed of an electrically conducting material, a number of pipe coils formed of an electrically conducting material and connected to and extending between said inlet and outlet pipes for flowing the fluid from said inlet pipe to said outlet pipe, each said pipe coil being arranged in a vertical plane with the vertical planes of said pipe coils disposed in parallel relation, a restriction located in each said pipe coil at its connection to said inlet pipe, an alternating current source for supplying electric current to each of said pipe coils for resistive heating thereof and thereby of the fluid flowing therethrough, said alternating current source having $n$ phases and said plurality of pipe coils being a multiple of $n$, means connecting each of the phases of said alternating current sources to a different $1/n$ of said plurality of pipe coils substantially at the central points thereof located midway along the pipes of the pipe coils between said inlet and outlet pipes, means associated with the ends of which of said pipe coils for completing the circuit to the respective phases of the alternating current source, said connecting means including a separate current bar for and electrically connected to each of said pipe coils, said current bars extending substantially parallel to each other and being electrically connected to the phases of the alternating current source in a regular alternating and repetitive order, said current bars being thin bars arranged edgewise vertically, and electrically insulatng spacer means disposed between and separating said current bars for enabling air flow between said current bars.

* * * * *